US005244351A

United States Patent [19]

Arnette

[11] Patent Number: 5,244,351

[45] Date of Patent: Sep. 14, 1993

[54] SYSTEM FOR PROTECTING A LIQUID PUMP

[75] Inventor: Henry K. Arnette, Fort Mill, S.C.

[73] Assignee: Textron Inc., Providence, R.I.

[21] Appl. No.: 954,752

[22] Filed: Sep. 30, 1992

[51] Int. Cl.[5] ..... F04D 15/02

[52] U.S. Cl. ..... 417/38; 417/44; 417/234; 137/202

[58] Field of Search ..... 417/44, 234, 38; 137/202, 519.5

[56] References Cited

U.S. PATENT DOCUMENTS

| | | | |
|---|---|---|---|
| 785,594 | 3/1905 | Crispin | 137/202 |
| 2,687,693 | 8/1954 | Hudson | 103/25 |
| 2,741,988 | 4/1956 | Merritt | 103/25 |
| 2,804,516 | 8/1957 | Staak | 200/83 |
| 2,910,003 | 10/1959 | Kaatz | 103/25 |
| 2,969,740 | 1/1961 | Kaatz | 103/25 |
| 3,104,614 | 9/1963 | Gramenzi | 103/25 |
| 3,794,789 | 2/1974 | Bynum | 200/83 Z |
| 3,885,739 | 5/1975 | Tuttle | 239/124 |
| 4,815,941 | 3/1989 | Fayo | 417/53 |
| 4,861,231 | 8/1989 | Howard | 417/38 |
| 4,926,904 | 5/1990 | Polk et al. | 417/234 |
| 5,040,950 | 8/1991 | Dalquist, III et al. | 417/234 |
| 5,064,347 | 11/1991 | LaValley, Sr. | 417/9 |
| 5,086,975 | 2/1992 | Paige | 239/124 |

*Primary Examiner*—Richard A. Bertsch
*Assistant Examiner*—David W. Scheuermann
*Attorney, Agent, or Firm*—Perman & Green

[57] ABSTRACT

A combined air vent and pressure switch are provided at the inlet of a liquid pump. The air vent is adapted to exhaust air from a supply line, such as a garden hose, and thereby substantially prevent the pump from running dry before water from the hose reaches the inlet. The pressure switch is connected to the motor of the pump and is adapted to signal the motor to stop if the pressure switch senses a low pressure condition at the pump inlet, such as when there is inadequate liquid or no liquid at the pump inlet. The features of the air vent and pressure switch combine to prevent the pump from being damaged by running the pump without adequate liquid supply.

16 Claims, 1 Drawing Sheet

SYSTEM FOR PROTECTING A LIQUID PUMP

BACKGROUND OF THE INVENTION

1. Field of the Invention

The present invention relates to liquid pumps and, more particularly, to a system for preventing damage to a pump that would otherwise occur by running the pump without an adequate liquid supply.

2. Prior Art

U.S. Pat. No. 3,885,739 to Tuttle discloses a pressure fluid cleaning device with a dump valve that is closed by activation of a trigger. U.S. Pat. No. 2,969,740 to Kaatz discloses a sump pump with a pressure switch adapted to deactivate the pump in the absence of liquid. U.S. Pat. No. 2,741,988 to Merritt discloses a system adapted to shut off power to a motor of a pump in the event the pump should lose its prime. U.S. Pat. No. 3,104,614 to Gramenzi discloses a control device Other U.S. Patents relating to pumps include 2,687,693; 2,804,516; 2,910,003; 3,794,789; 4,861,231; and 5,064,347.

As noted from the above cited references, it is generally not desirable to operate a liquid pump without the presence of a liquid at its inlet because the pump could become damaged. There also exists in the prior art systems known as pressure washers that comprise a motor driven liquid pump and a wand such as disclosed in U.S. Pat. No. 5,086,975. As noted in U.S. Pat. No. 5,086,975, liquid is supplied to the pump by a hose. Problems have arisen in regard to supplying liquid to pumps by means of disconnectable hoses, such as garden hoses. First, the hose is usually connected to the pump prior to supplying liquid to the hose. Air, trapped in the hose, is thus pushed into the pump causing the pump to operate without the proper presence of liquid. Second, occasionally, a water supply to the pump is interrupted (or the pump is started without being properly connected to the water supply), such as when the hose becomes kinked, etc. This causes a loss of supply of water to the pump. Operating the pump without an adequate supply of water can thus result in damage to the pump.

It is an object of the present invention to overcome problems in the prior art and provide a new and improved system for protecting a liquid pump from damage from inadequate liquid supply.

SUMMARY OF THE INVENTION

In accordance with one embodiment of the present invention, a system for protecting a liquid pump is provided. The system comprises a pressure switch, an air vent, and means for deactivating the pump. The pressure switch is connected to a liquid supply inlet of the pump. The air vent is connected to the liquid supply inlet of the pump. The means for deactivating the pump can deactivate the pump upon the pressure switch sensing a predetermined pressure at the liquid supply inlet.

In accordance with another embodiment of the present invention, a system for protecting a liquid pump is provided comprising a housing, a pressure switch, and an air vent. The housing has a liquid conduit, means for connecting the housing to a liquid inlet of the pump, and means for connecting a water supply to the housing. The pressure switch is attached to the housing and communicates with the conduit The air vent is also connected to the housing and communicates with the conduit.

BRIEF DESCRIPTION OF THE DRAWINGS

The foregoing aspects and other features of the invention are explained in the following description, taken in connection with the accompanying drawings, wherein.

DETAILED DESCRIPTION OF THE INVENTION

Figure 1:
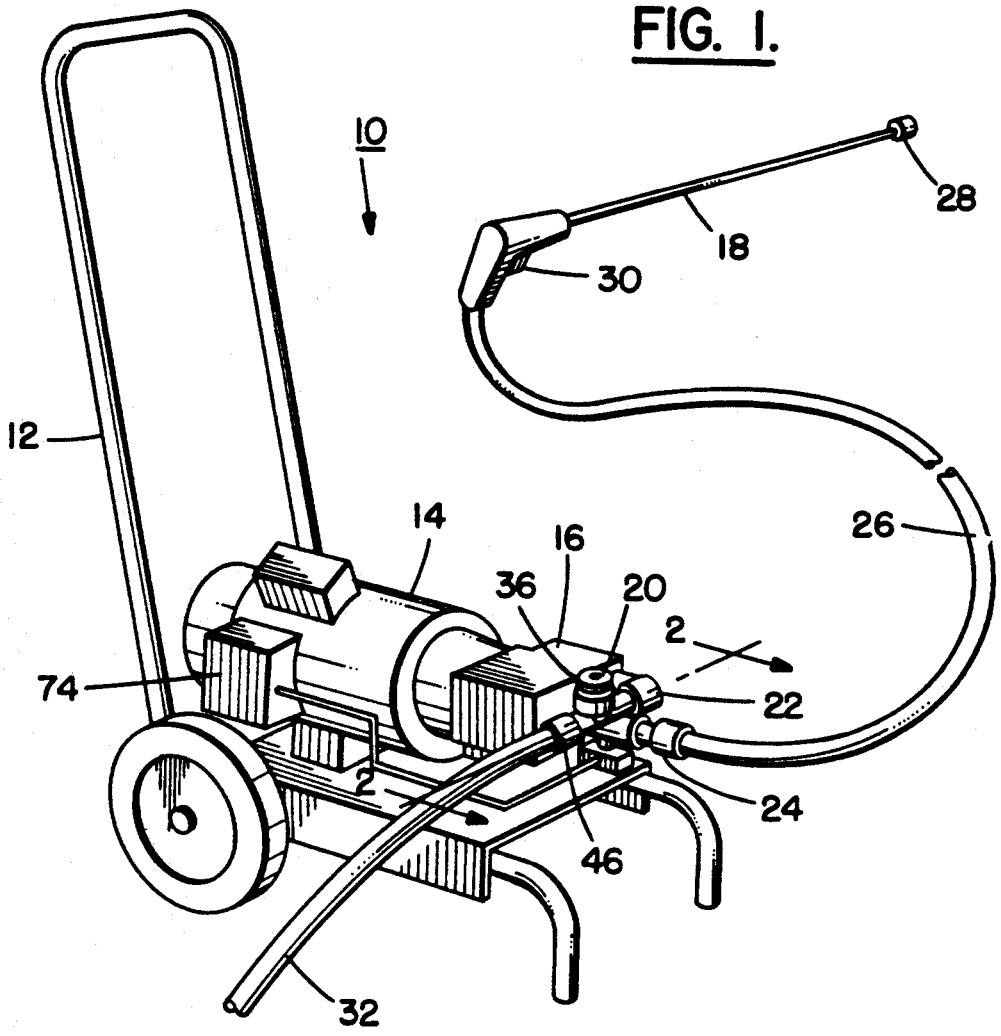
FIG. 1 is perspective view of a pressure washer incorporating features of the present invention.

Referring to FIG. 1, there is shown a perspective view of a pressure washer 10 incorporating features of the present invention. Although the present invention will be described with reference to the single embodiment shown in the drawings, it should be understood that the present invention can be incorporated into different types of embodiments and may be used with different types of pumps. In addition, any suitable size, shape or type of members or materials could be used.

The pressure washer 10 generally comprises a base unit 12 having a motor 14 and a pump 16, a wand 18, and a pump inlet protection system 20. The motor 14, in the embodiment shown, is an electric motor operably connected to the pump 16 to drive the pump. However, in an alternate embodiment, an internal combustion engine could be provided The pump 16 is of conventional design with a pump inlet 22 and a pump outlet 24. The wand 18 is operably connected to the pump outlet 24 by means of a hose 26. Pressurized liquid, such as water, can thus be dispensed from the pump 16, through the hose 26, and out the nozzle end 28 of the wand 18 by a user depressing the wand trigger 30. In the embodiment shown, supply of liquid to the pump 16 is provided by a hose 32, such as a garden hose connected to a domestic water supply. However, the supply of liquid could be any suitable supply including a liquid tank truck, etc.

Figure 2:
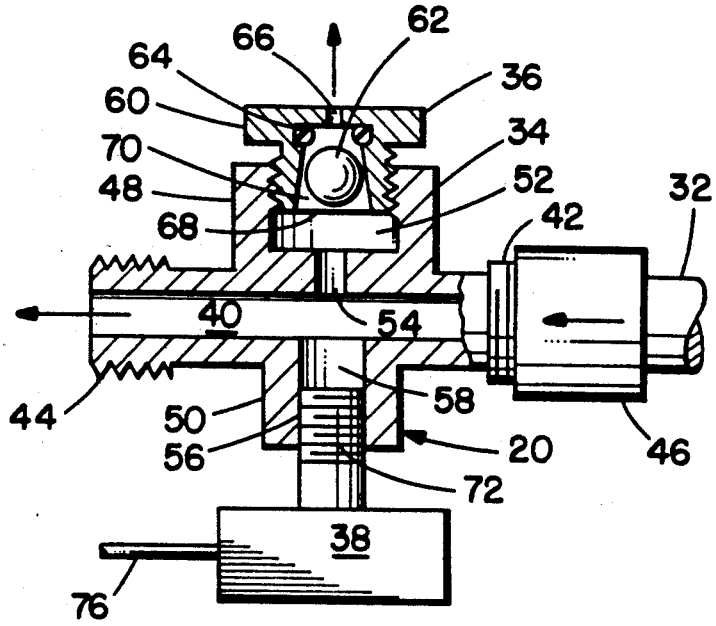
FIG. 2 is a schematic partial cross sectional view of a pressure switch and air vent protector used in the pressure washer shown in FIG. 1.

Referring also to FIG. 2, an enlarged schematic cross-sectional view of one of the components of the pump inlet protection system 20 taken along line 2—2 of FIG. 1 is shown. The system 2 generally comprises a housing 34, an air vent 36, and a pressure sensor or switch 38. The housing 34 can be made of any suitable material such as metal or plastic. The housing 34 has a conduit 40 therethrough between a first threaded end 42 and a second threaded end 44. The first threaded end 42 is adapted to have a coupling 46 of the garden hose 32 connected thereto to supply water to the conduit 40. However, any suitable type of coupling or connection could be provided The second threaded end 44 is adapted to be threadingly coupled to the pump inlet 22 However, any suitable type of coupling or connection could be provided In an alternate embodiment of the present invention, the housing 34 could be integrally formed with the pump inlet 22. The second threaded end 44 allows the housing 34 to be removed from the inlet 22 in the event it becomes damaged and needs to be repaired or replaced. It also allows the housing 34 to be connected to pumps currently on the market thereby allowing these pumps to be upgraded with the protection system 20. In the embodiment shown, the housing 34 also comprises an air vent connection section 48 and a pressure switch connection section 50. As can be seen, the air vent connection section has a threaded receiving area 52 with a channel 54 extending from the conduit 40 into the receiving area 52. The pressure switch connection section 50 also has a threaded receiving area 56 and a channel 58 extending from the conduit 40 into the receiving area 56.

The air vent 36 generally comprises a frame 60, a float ball 62, and a seal 64. The frame 60 is threadingly mounted to the housing 34 at the receiving area 52. The frame 60 includes a relatively small air outlet or vent aperture 66, a relatively large air inlet aperture 68 with a generally conical recess 70 between the two apertures. The seal 64 is located between the outlet aperture 66 and the conical recess 70 to allow the float ball 62 to be seated against the seal 64 and thereby close the path between the inlet aperture 68 and the outlet aperture 66. The seal 64, in the embodiment shown, is merely an O-ring seal. However, any suitable type of seal could be provided The float ball 62 is comprised of a lightweight material adapted to float in the liquid being pumped, such as water. The ball 62 is suitably sized and shaped to be movable in the recess 70 and sealable against the seal 64. However, in an alternate embodiment of the invention, any suitable type of sealing or closure system could be provided and any suitable type of closeable air vent could also be provided. When the float ball 62 is not seated against the seal 64, a path exists between the conduit 40 and the vent outlet 66 When the float ball 62 is seated against the seal 64, that path is closed.

The pressure switch 38 is of conventional design with a probe end 72 threadingly connected to the housing 34 at the receiving area 56. In the embodiment shown, the pressure switch 38 is located directly opposite the air vent 36 in order to minimize the size of the housing 34. However, the pressure switch 38 can be located at any suitable location at the fluid inlet. The switch 38 is electrically connected to an on/off control 74 of the motor 14 by means of electrical wire 76. In alternate embodiments, the switch 38 may be an electrical and/or mechanical connection to an ignition control, or to the throttle of the motor, or to a shut-off system of the an internal combustion engine, or to a disconnect between the pump 16 and motor 14 to stop the motor from driving the pump, etc. In the embodiment shown, the pressure switch 38 is adapted to sense pressure at the channel 58 and, thus, senses pressure in the housing 34. The switch 38 is adapted to transmit a signal, or transmit a current of electricity, or establish a ground path to the control 74 based upon sensed pressure.

The operation of the system 20 will now be described. During normal operation of the pressure washer 10, liquid from hose 32 passes through the conduit 40, into pump inlet 22, out pump outlet 24, through hose 26, and to the wand 18 for discharge when the uses depresses the trigger 30. The pump 16 increases the pressure of the liquid such that it can exit the nozzle 28 at an elevated velocity. As the liquid passes through the housing 34 its pressure is sensed by the pressure switch 38 and, the float ball 62 is pressed against the seal 64 thereby closing off the vent outlet 66 preventing liquid from exiting the outlet 66. In the event that supply of liquid to the first end 42 is interrupted (for whatever reason), the pressure switch 38 senses the drop in pressure and signals the control 74 of this event. In a preferred embodiment, the switch 38 signals the control 74 of the pressure drop only upon reaching a predetermined pressure, such as 5 psi. Upon receiving the low pressure signal from the switch 38, the control 74 automatically stops the motor 14 thereby stopping the pump 16. This protects the pump 16 from being damaged that could otherwise occur by operating the pump without adequate lubrication and cooling provided by the water. The pressure switch 38 also prevents the motor 14 from being started without an adequate pressurized water supply being provided to the pump inlet.

The air vent is provided to allow air, such as might be in the garden hose 32 when initially connected to the housing 34, to be vented prior to starting the motor 14 and pump 16. The float ball 62, without liquid in the area 52, would be in a down position, due to gravity, thereby allowing a path for air to automatically vent from the conduit 40 to outlet 66 as liquid travels through the hose 32 pushing the air in front of it. When the air is vented and liquid passes into the area 52 and recess 70, the ball 62, being lighter than the liquid, is lifted up and pressed against the seal 64. Because the ball 62 is lightweight, the air vent has been adapted to prevent air passing through the air vent from picking up the ball 62 prematurely causing the ball to seat against the seal 64 before the air is vented. To prevent this from occurring, the channel 54 below the ball and the interior sides of the recess 70 are relatively large compared to the outlet 66 to slow down the velocity of air as it passes around the ball. By allowing trapped air in the supply hose 32 to escape prior to starting the motor 14 and pump 16, this also protects the pump 16 from damage that could otherwise occur by running it without the lubrication and cooling provided by the liquid. Because the frame 60 is removably attached to the housing 34, the ball 62 and seal 64 can also be replaced if they become damaged.

It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. A system for protecting a liquid pump, the system comprising:
   - a pressure switch connected to a liquid supply inlet of the pump;
   - an air vent connected to the liquid supply inlet of the pump; and
   - means for deactivating the pump upon the pressure switch sensing a predetermined pressure at the liquid supply inlet.

2. A system as in claim 1 wherein the air vent includes a float adapted to close a vent aperture.

3. A system as in claim 1 wherein the air vent has a relatively large air inlet and a relatively small air outlet.

4. A system as in claim 1 wherein the air vent has a lightweight float ball and means to decrease air velocity around the ball.

5. A system as in claim 1 wherein the means for deactivating the pump comprises the pressure switch being electrically connected to a control on a motor of the pump and being adapted to deactivate the motor.

6. A system as in claim further comprising a housing having a conduit with the pressure switch and air vent connected thereto.

7. A system as in claim 6 wherein the housing has means to connect a garden hose to the housing.

8. A system as in claim 6 wherein the housing has means to removably connect the housing to the liquid supply inlet of the pump.

9. A system as in claim 6 wherein the air vent and pressure switch are removably connected to the housing.

10. A system for protecting a liquid pump, the system comprising:

a housing having a liquid conduit, means for connecting the housing to a liquid inlet of the pump, and means for connecting a water supply to the housing;

a pressure switch attached to the housing and communicating with the conduit; and an air vent connected to the housing and communicating with the conduit.

11. A system as in claim 10 further comprising a motor control connected to a pump motor and the pressure switch such that, upon the pressure switch sensing a low pressure condition at the conduit, the pressure switch can signal the motor control to prevent operation of the motor.

12. A system as in claim 10 wherein the air inlet has a relatively large air inlet aperture and a relatively small air outlet aperture.

13. A system as in claim 10 wherein the air vent is adapted to allow air to exit the conduit and, automatically close upon liquid from the conduit entering the air vent.

14. A system as in claim 10 wherein the air vent includes a frame and a float ball.

15. A system as in claim 14 wherein the air vent frame has an outlet aperture and a generally conical recess to the outlet aperture adapted to house the float ball.

16. A system as in claim 15 wherein the air vent further comprises a seal located between outlet aperture and the conical recess to allow the float ball to be sealed against the seal and thereby close a path between the recess and the outlet aperture.

* * * * *